US010107088B2

(12) United States Patent
Stachowiak et al.

(10) Patent No.: US 10,107,088 B2
(45) Date of Patent: Oct. 23, 2018

(54) CENTRIFUGAL SEPARATOR FOR DOWNHOLE PUMP

(71) Applicant: Weatherford Technology Holdings, LLC, Houston, TX (US)

(72) Inventors: John E. Stachowiak, Houston, TX (US); Santhosh Ramaswamy, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 230 days.

(21) Appl. No.: 15/048,805

(22) Filed: Feb. 19, 2016

(65) Prior Publication Data

US 2016/0251951 A1 Sep. 1, 2016

Related U.S. Application Data

(60) Provisional application No. 62/118,994, filed on Feb. 20, 2015, provisional application No. 62/119,980, filed on Feb. 24, 2015.

(51) Int. Cl.
*E21B 43/38* (2006.01)
*E21B 43/12* (2006.01)

(52) U.S. Cl.
CPC ..... *E21B 43/38* (2013.01); *E21B 43/121* (2013.01); *E21B 43/128* (2013.01)

(58) Field of Classification Search
CPC ..... E21B 43/121; E21B 43/128; E21B 43/38
USPC ..... 166/105.1, 105.3, 105.4
See application file for complete search history.

(56) References Cited

U.S. PATENT DOCUMENTS 1,548,803 A * 8/1925 Cotton ..... F04B 47/005 166/105.1
1,604,019 A * 10/1926 Carnes ..... E21B 43/38 166/105.1
1,623,015 A * 3/1927 Lawrence ..... F04B 47/005 166/105.3
5,314,018 A * 5/1994 Cobb ..... E21B 43/38 166/105.1

(Continued)

OTHER PUBLICATIONS

The Cavins Corporation; "The 'Sandtrap' Downhole Desander"; http://cavinscorp.com/sales.html; obtained from internet Feb. 9, 2015; pp. 1-4.

(Continued)

*Primary Examiner* — Jennifer H Gay
(74) *Attorney, Agent, or Firm* — Blank Rome LLP

(57) ABSTRACT

A separator removes solids from downhole fluid of a wellbore for intake of a downhole pump and allows the removed solids to pass out an outlet downhole of the separator. The separator handles erosion that may occur by having first and second inner bodies disposed in an outer body. The first inner body and extends from intake to a first distal end in the interior, whereas the second inner extends from adjacent an outlet to a second distal end in the interior. A space between the second distal end disposed about the first distal end allows for fluid entering an inlet of the outer housing to pass into the second inner body. A flow body disposed in the space can then produce flow in the downhole fluid separating particulate from the downhole fluid passing from the inlet, to the interior, through the defined space, and to the second passage.

20 Claims, 4 Drawing Sheets

(56) References Cited

U.S. PATENT DOCUMENTS

| | | | | |
|---|---|---|---|---|
| 5,474,601 | A * | 12/1995 | Choi | B01D 19/0057 166/105.3 |
| 5,516,360 | A * | 5/1996 | Normandeau | B01D 19/0052 166/105.5 |
| 5,662,167 | A | 9/1997 | Patterson et al. | |
| 5,810,081 | A * | 9/1998 | Cobb | E21B 17/00 166/105.3 |
| 6,382,317 | B1 * | 5/2002 | Cobb | E21B 43/38 166/105.5 |
| 6,412,563 | B1 | 7/2002 | William Sl Clair et al. | |
| 7,713,035 | B2 | 5/2010 | Ford | |
| 7,909,092 | B2 | 3/2011 | Cobb | |
| 8,051,907 | B2 | 11/2011 | Cobb | |
| 8,136,600 | B2 * | 3/2012 | Fowler | B01D 19/0057 166/267 |
| 8,881,803 | B1 | 11/2014 | Frost | |
| 2003/0196952 | A1 * | 10/2003 | Kampfen | B01D 21/2411 210/512.3 |
| 2009/0211763 | A1 * | 8/2009 | Fowler | B01D 19/0057 166/357 |
| 2010/0175869 | A1 * | 7/2010 | Cobb | B04C 5/081 166/105.1 |
| 2010/0258297 | A1 * | 10/2010 | Lynde | E21B 37/00 166/105.1 |
| 2014/0158343 | A1 | 6/2014 | Cobb et al. | |
| 2016/0251951 | A1 * | 9/2016 | Stachowiak | E21B 43/121 166/265 |

OTHER PUBLICATIONS

International Search Report and Written Opinion in counterpart PCT Appl. PCT/US2016/018768, dated May 11, 2016, 11-pgs.

* cited by examiner (Background)

(Background)

CENTRIFUGAL SEPARATOR FOR DOWNHOLE PUMP

CROSS-REFERENCE TO RELATED APPLICATIONS

This application claims the benefit of U.S. Provisional Appl. 62/118,994, filed 20 Feb. 2015, and Appl. 62/119,980, filed 24 Feb. 2015, which are both incorporated herein by reference.

BACKGROUND OF THE DISCLOSURE

Artificial lifts system having downhole pumps are widely used in wells to lift liquid produced in the well to the surface. To reduce wear, plugging, and other issues from sand and other solid particles, the intake of the downhole pumps can be fitted with a sand control system. For example, screens and filters can be used to filter out sand and other particles before it can enter the pump. Yet, these device may eventually become plugged or may not prevent particles of a smaller size. A centrifugal separator is a more effective way to reduce the flow of sand and foreign particles that can reach the downhole pump.

As shown in FIGS. 1A-1B, casing 10 has perforations 12 toward a downhole end for entry of well fluids. A downhole pump 20 disposed in the casing 10 extends from a tubing string (not shown), which extends toward the surface. Extending from the pump 20, a centrifugal separator 30 is positioned near the perforations 12.

In FIG. 1A, the downhole pump 20 is a reciprocating rod-type pump for lifting liquid in tubing uphole to the surface. In this arrangement, the separator 30 mounts to the intake 22 of the pump 20 with tubing 16 and connector 18. As is known, such a pump 20 typically has a barrel in which a plunger can reciprocate by a sucker rod string extending from surface equipment.

In FIG. 1B, the downhole pump 20 is an electric submersible pump for lifting liquid in tubing uphole to the surface. In this arrangement, the separator 30 mounts downhole from the pump 20 using a packer 17, tubular housing 16, and the like. As is known, such a submersible pump 20 typically has a pump unit 21*a* driven by an electric motor 21*b* supplied with electrical energy from an electrical cable 21*c* extending from the surface. The packer 17 is positioned on the tubing 16 between the separator 30 and the pump 20. Production fluids are diverted into the separator 30, back into the casing 10 uphole of the packer 17, past the motor 21*b* for cooling, and into the pump intake 22.

In both of these arrangements, sand 15 in the well fluids from the adjacent formation enters the casing 10 through the perforations 12. To remove the sand 15 and other particles from the well fluid before it reaches the pump 20, the separator 30 first intakes the well fluid from the perforations 12 and separates the heavier solid sand and particles from the fluid before the pump 20 lifts the fluid through the tubing string.

Below the centrifugal separator 30, the assembly has a collector 40 with one or more mud anchor joints 40 that form a collection volume for solid particles from the separator 30. A bull plug 44 can plug the end of joints 42. The collector 40 collects sand and other solid particles and may be of a substantial length (e.g., thirty to three hundred feet). Instead of a bull plug 44, the collector 40 can have a dump valve to dump solids into the lower rathole on each downstroke of the pump 20.

As an example, FIG. 2A shows a centrifugal separator 30 for separating solid particles from the well fluid in the wellbore. The separator 30 is similar to that disclosed in U.S. Pat. No. 5,314,018.

A gas anchor body 34 connects to the tubing 16 with a connection 18*a*. The body 34 has inlet ports 32 for the well fluid flow to enter. The anchor body 34 connects to a desander body 35 with a connection 18*b*. The desander body 35 has a connection 18*c* that connects to a collector 40 having mud anchor joints 42 and bull plug 44. An orifice tube 36 extends down through the anchor body 34 to the desander body 35 and has a spiral head 38 on its distal end.

As noted above, such a centrifugal separator 30 is a preferred device for removing solids from the well fluid before it is pulled into the intake of the downhole pump 20. Produced fluids WF enter the separator 30 through the inlet slots 32 and flows down into the desander body 35 and through the spiral 38 to enter the orifice tube 36 and flow upward to the pump (20). The spiral 38 makes the flow follow a circular path through a "spiral-shaped" annular space. Details of the spiral on the orifice tube and the flow of fluid are shown in more detail in FIG. 2B. Through centrifugal action, the heavier particles S are forcibly spun against the desander body 35 and settle into the collector 40. Meanwhile, cleaner fluid CF remains at or near the axis of the intake tube 36 concentric to the desander body 35, thus allowing this "clean" fluid CF to be pulled into the intake for the pump (20).

The spinning action of the heavier (and very hard/abrasive) sand S wears against and erodes the inner diameter of the desander body 35. This erosion occurs to the point where the lower section of the separator 30 comes apart and drops into the well. In particular, the section of the desander body 35 at about the location of the spiral 38 parts, and the section of the body 35 along with the connected mud anchor joints 42 and the bull plug 44 drop into the well.

To address the issue of the separator coming apart, it is known in the art to incorporate milled flats on the outer diameter of the desander body. An example of such a separator is disclosed in U.S. Pat. No. 5,810,081, which is reproduced in FIG. 3. A milled flat 38 is made in an outer tubular member 20 of a separator 18. The milled flat 38 essentially reduces the wall thickness in the eroding section of the tubular member 20 near a spiral 32. During use, the reduced wall thickness eventually allows the sandy fluid to break through the tubular member 20 at 39 near a funnel 48. Once the fluid breaks through, the centrifugal spiral action stops, preventing the tubular member 20 from parting and keeping the lower section of the assembly from dropping into the well. This is effective, but reduces the life of the separator 18 and increases the production cost due to the machining operation required to mill the flats.

The subject matter of the present disclosure is directed to overcoming, or at least reducing the effects of, one or more of the problems set forth above.

SUMMARY OF THE DISCLOSURE

In a first embodiment, a separator removes solids from downhole fluid of a wellbore for intake of a downhole pump and allows the removed solids to pass out an outlet downhole of the separator. The separator comprises an outer body, a first inner body, a second inner body, and a flow body. The outer body extends from adjacent the intake of the downhole pump. The outer body has an interior, an inlet, and an outlet, and the inlet communicates the downhole fluid in the wellbore with the interior.

The first inner body is at least partially disposed in the outer body and extends from a first proximal end adjacent the intake to a first distal end in the interior. The first inner body defines a first passage communicating the first distal end with the intake adjacent the first proximal end. The second inner body is also at least partially disposed in the outer body. However, the second inner body extends from a second proximal end adjacent the outlet to a second distal end in the interior. The second inner body defines a second passage communicating the second distal end with the outlet adjacent the second proximal end. This second distal end is disposed about the first distal end of the first inner body and defines a space for fluid communication therebetween.

The flow body is disposed in the space between the first and second inner bodies. The flow body produces flow in the downhole fluid separating particulate from the downhole fluid passing from the inlet, to the interior, through the defined space, and to the second passage.

A blocking body can be disposed in a region between the second inner body and the outer housing to at least partially block the region. For example, the blocking body can be a seal, a filter, or a funnel.

The second passage of the second inner body communicates the separated particular to the outlet, while the first passage of the first inner body communicates the downhole fluid in the second passage to pass to the intake of the downhole pump. For its part, the flow body can include a spiral formed in the space between the first distal end of the first inner body at least partially disposed in the second distal end of the second inner body.

The outer body can include a tubular housing having one end coupled toward the intake and having another end coupled toward the outlet. The inlet can be one or more openings defined in a sidewall of the tubular housing. In a similar fashion, the first inner body can include a first tubular disposed in the outer body and having a first diameter, while the second inner body can include a second tubular disposed in the inner body and having a second diameter greater than the first diameter. This second tubular can have a full wall thickness all around along its length; a hard coating disposed at least in the second passage; a different material than the first tubular and/or the outer housing; and a shorter length than the first tubular and/or the outer housing.

In a second embodiment, a separator removes solids from fluid of a wellbore for intake of a downhole pump and allows the removed solids to pass out an outlet downhole of the separator. The separator includes a first inner body, a second outer body, and an outer housing. The first inner body extends from adjacent the intake and defining a first passage communicating the intake with a first distal end. The second inner body extends from adjacent an outlet and defines a second passage communicating the outlet with a second distal end. The second distal end is disposed about the first distal end and defines a space for fluid communication therebetween.

The outer body extends from adjacent the intake toward the outlet and is disposed about the first and second inner bodies. The outer body has an inlet communicating the wellbore with an interior of the outer body, and the interior communicates with the space. In turn, the space disposed in the space between the first and second inner bodies separates particulate from the downhole fluid passing from the inlet, to the interior, through the defined space, and to the second fluid passage. In particular, a flow body disposed in the space between the first and second inner bodies producing flow in the downhole fluid separating the particulate from the downhole fluid passing from the inlet, to the interior, through the defined space, and to the second fluid passage In a third embodiment, an apparatus for lifting fluid in a wellbore comprises a downhole pump, a collector, and a separator. The downhole pump has an intake, and an outer body of the separator extends from adjacent the intake. The outer body has an interior with an inlet communicating the interior with the wellbore. The collector extends from the outer body.

The separator includes a first inner body disposed in the outer body and extending from adjacent the intake to a first distal end in the outer body. The first inner body defining a first passage communicating the first distal end with the inlet. The separator also includes a second inner body disposed in the outer body and extending from adjacent the collector to a second distal end between the outer body and the first inner body. The second inner body defines a second passage, which communicates the collector with the first passage and defines a space with the first inner body in fluid communication with the interior of the outer body. A flow body disposed in the space produces flow in the downhole fluid separating particulate from the downhole fluid passing from the inlet, to the interior, through the defined space, and to the second fluid passage.

In a fourth embodiment, a method of removing particles from fluid of a wellbore to an intake of a downhole pump involves: taking in the fluid into an interior through an inlet in communication with the wellbore; passing the fluid in the interior through a space between a second inner body disposed at least partially in a first inner body; separating particulate from the fluid passing through the space into a first passage of the first inner body; collecting the separated particulate to a collector downhole of the first inner body; and taking up the fluid in the first passage through a second passage in the second inner body to the intake.

The foregoing summary is not intended to summarize each potential embodiment or every aspect of the present disclosure.

DETAILED DESCRIPTION OF THE DISCLOSURE

Figure 1A:
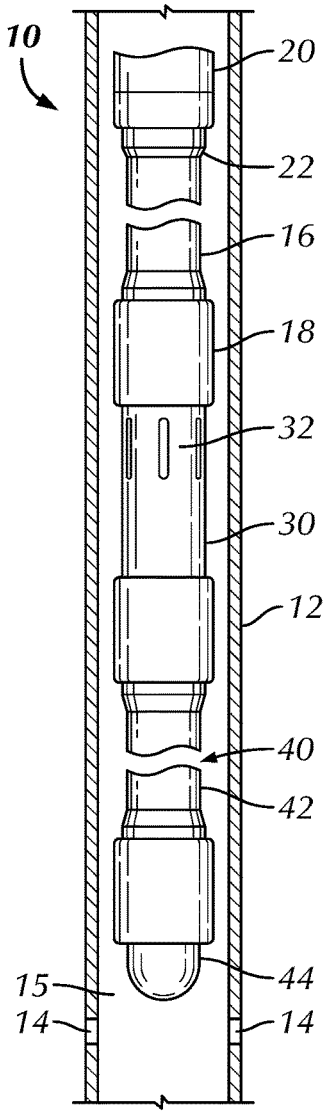
FIGS. 1A-1B illustrate examples of an artificial lift system having a downhole pump and a centrifugal separator according to background of the present disclosure.
Figure 1B:
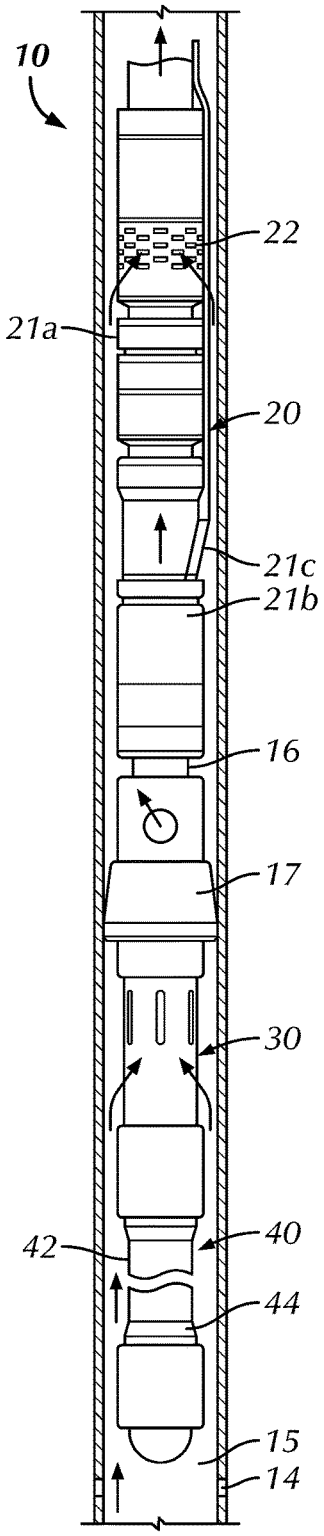
Figure 2A:
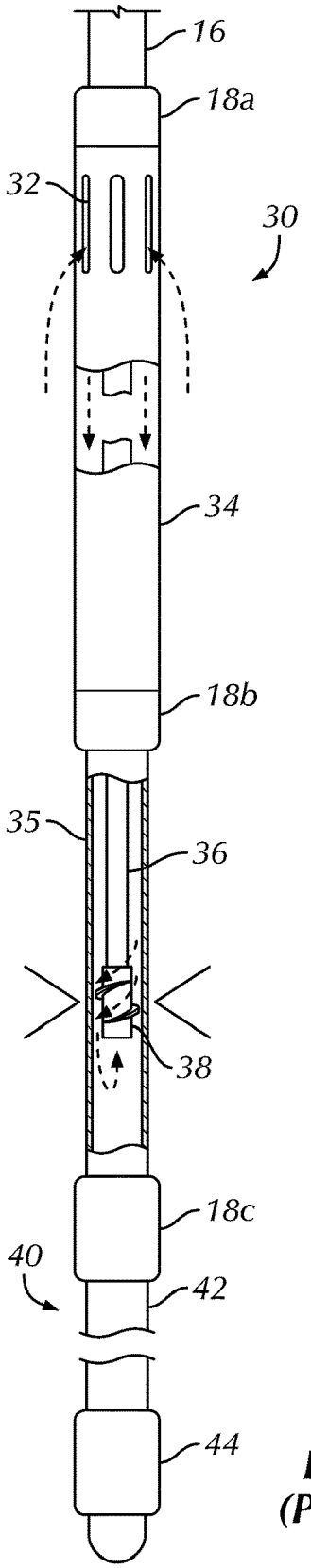
FIG. 2A (Prior Art)
FIG. 2A illustrates an example of a centrifugal separator according to the prior art for use with the downhole pump.
Figure 2B:
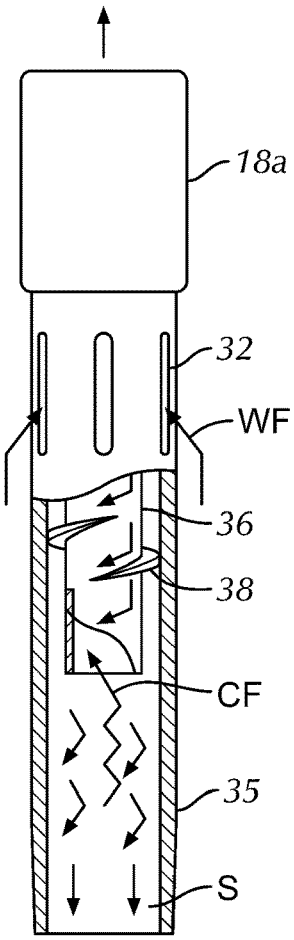
FIG. 2B (Prior Art)
FIG. 2B illustrates portion of the centrifugal separator of FIG. 2A in more detail.
Figure 3:
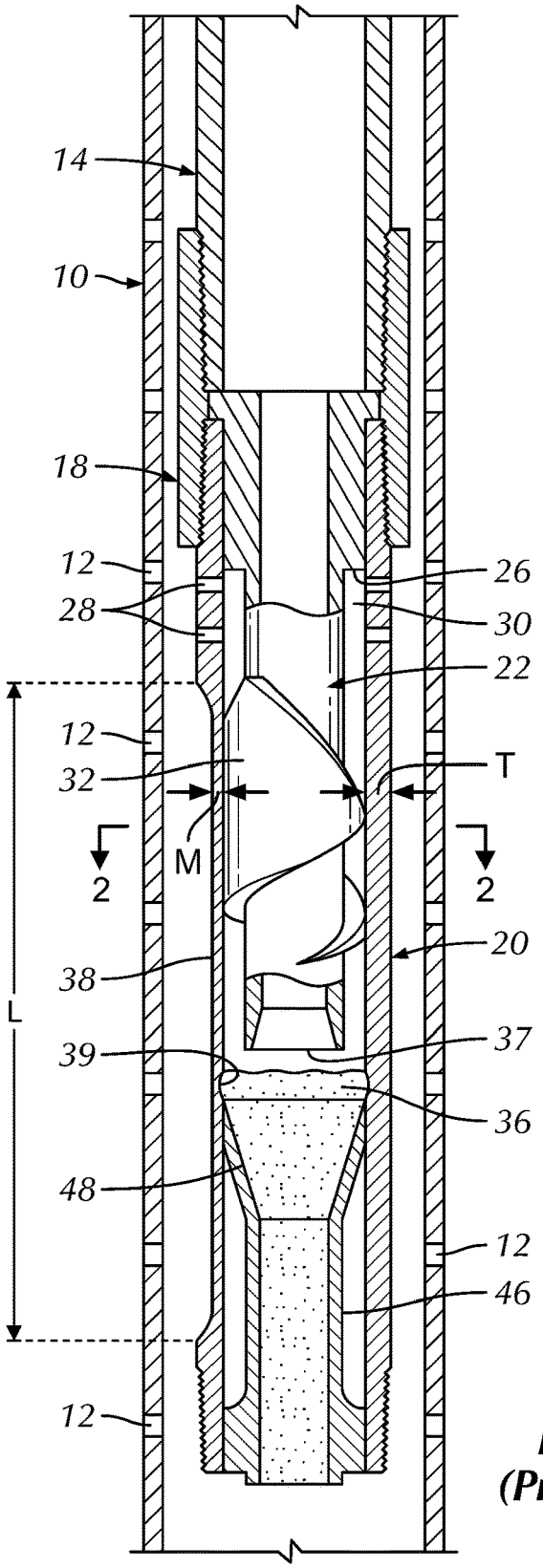
FIG. 3 (Prior Art)
FIG. 3 illustrates portion of another centrifugal separator according to the prior art.
Figure 4A:
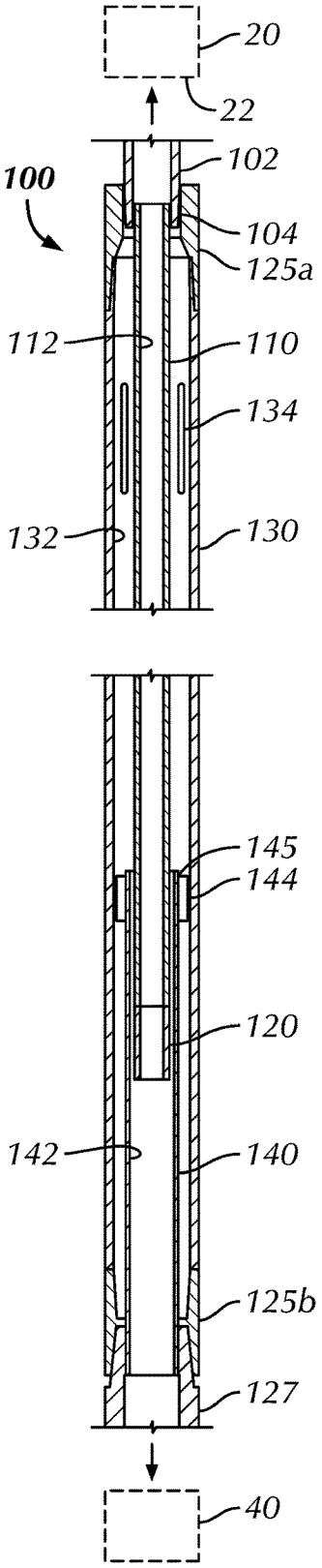
FIG. 4A illustrates a centrifugal separator according to the present disclosure for use with a downhole pump and a collector of an artificial lift system.
Figure 4B:
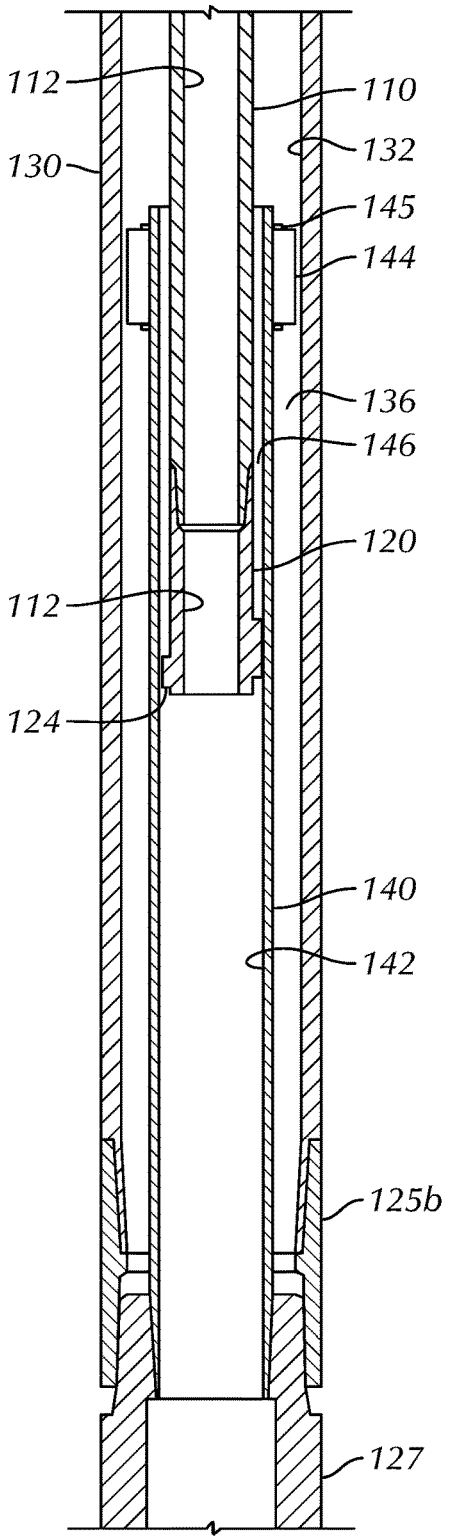
FIG. 4B illustrates portion of the centrifugal separator of FIG. 4A in more detail.

As shown in FIG. 3A, an apparatus for lifting fluid in a wellbore includes a downhole pump 20, a separator 100, and a collector 40. The downhole pump 20 has an intake 22 and can be any suitable type of pump for artificially lifting fluid in the wellbore. For example, the pump 20 can be a reciprocating rod type pump, electric submersible pump, or progressive cavity type pump. The separator 100 extends downhole of the pump 20 for separating out solids (e.g., sand, particles, etc.) in well fluid from the wellbore. The collector 40 extends downhole from the separator 100 and collects the separated solids from the well fluid.

The separator 100 has an outer body 130 having an interior 132 and having an inlet 134 communicating the interior 132 with the wellbore. A first inner body 110 extends from a first proximal end at the intake 22 to a first distal end within the outer body 130. The first inner body 110 defines a first fluid passage 112, and the distal end has a spiral 120 disposed thereabout. This first fluid passage 112 forms a first outlet for the separator 100 to communicate clean fluid to the intake 22 of the pump 20.

A second inner body 140 extends from a second proximal end at the bottom sub 127 to a second distal end between the outer body 130 and the first inner body 110. The second inner body 140 defines a second fluid passage 142. As arranged, the second fluid passage 142 communicates the collector 40 with the first fluid passage 112 of the first inner body 110 and also defines a space 146 with the first inner body 110 in fluid communication with the interior 132 of the outer body 130. This second fluid passage 142 forms a second outlet for the separator 100 to communicate solids or particulate (e.g., sand, particles, etc.) to the collector 40.

Looking more particularly at FIGS. 3A-3B, the separator 100 includes a seating nipple 102 that connects to the pump 20 either directly or using tubing, couplings, or the like. A reducing bushing (not shown) positioned at 104 connects the seating nipple 102 to the first inner body. Extending from the coupling 125*a*, the outer body or gas anchor body 130 connects by a coupling 125*b* to a bottom sub 127. When arranged in a downhole assembly as disclosed herein, the bottom sub 127 can connect to other downhole components, such as a collector 40 having a mud anchor joints and bull plug that form the collection volume for solids from the separator 100.

The first inner body or diptube 110 extends inside the interior 132 of the gas anchor body 130 from the upper seating nipple 102 toward a lower end. Opposed to the diptube 110, the second inner body or desander body 140 extends inside the interior 132 of the gas anchor body 130 from the lower coupling 125*b* toward the distal end of the diptube 110. A seal 144 disposed outside the distal end of the desander body 140 at least partially seals the outer annular space 136 with the anchor body 130. However, an inner annular space 146 is left between the exterior of the diptube 110 and the interior passage 142 of the desander body 140. A flow body 120, such as a spiral head having one or more spirals 124 or profiles, is disposed on the distal end of the diptube 110 in the inner annular space 146 with the desander body 140. An orifice or opening 122 on the head 120 communicates the interior 142 of the desander body 140 with the diptube's interior 112 to communicate fluid to the intake 22 of the pump 20. (As an alternative, the inner surface of the desander body 140 may define the one or more spirals or helical profiles.)

During operation of the pump 20 uphole of the seating nipple 102, well fluid and any particles entering the casing (10) from the perforations (12) is drawn in through the inlet slots 134 in the anchor body 130. The fluid and particles pass through the inner annular space 146 between the distal end of the diptube 110 and the desander body 140. The spiral head 120 with its spiral 124 imparts rotation to the passing fluid and particles, causing the heavier particles to flow outward toward the desander body 140 while the cleaner fluid remains more centrally to be taken up through the open end 122 of the head 120 and into the diptube's interior passage 112.

As seen, the separator 100 has the desander body 140 supported from below and extending up over the spiral body 120 of the diptube 110. This allows the desander body 140 to be manufactured with a full wall thickness all around. In the event that the sandy fluid erodes the desander body 140 through the entire cross section, no separator components drop into the well because the desander body 140 is supported by the bottom sub 127. The anchor body 130 remains intact and is not eroded through.

Additionally, the desander body 140 can be shorter in length than the outer body 130. Therefore, the body 140 can be composed of alternate materials, or hard coatings may be used on the inside of the body 140 without adding to much additional expense. With this arrangement of the inner desander body 140, however, there is a chance that the desander body 140 and the gas anchor body 130 become sanded together as the sand fills and packs into the dead region between them. For this reason, the desander body 140 uses the seal 144 or filter to block the particulate from settling in this region. This seal 144 or filter may be comprised of, but is not limited to, rubber, plastic, steel, or other material. In one embodiment, the seal 144 or filter can be an annular brush held onto the desander body 140 with lock rings 145 or other fasteners. The seal 144 or filter can entirely or partially block off the annular region. Other structures, including screens, funnels, and the like, can be used to block off the annular region.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A separator for an intake of downhole fluid in a downhole pump disposed in a wellbore and for output of particulate to a collector disposed in the wellbore, the separator comprising:

an outer body having an uphole end and a downhole end and supporting the collector to the downhole pump, the uphole end extending from adjacent the intake of the downhole pump, the downhole end connected downhole toward the collector, the outer body having an interior and an inlet, the inlet disposed toward the uphole end and communicating the downhole fluid in the wellbore with the interior;

a first inner body at least partially disposed in the outer body, the first inner body extending from a first proximal end to a first distal end, the first proximal end disposed toward the uphole end of the outer body adjacent the intake, the first distal end disposed in the interior of the outer body, the first inner body defining a first passage communicating the first distal end with the intake adjacent the first proximal end;

a second inner body at least partially disposed in the outer body, the second inner body extending from a second proximal end to a second distal end, the second proximal end disposed toward the downhole end of the outer body and communicating with the collector, the second distal end disposed in the interior of the outer body, the second inner body defining a second passage communicating the second distal end with the second proximal end, the second distal end disposed about the first distal end of the first inner body and defining a space for fluid communication therebetween;

a blocking body disposed between the second distal end of the second inner body and an intermediate portion of the outer body between the uphole and downhole ends, the blocking body at least partially blocking communication of the inlet with a region between the second inner body and the outer body; and a flow body disposed in the space between the first and second inner bodies and producing flow in the downhole fluid separating particulate from the downhole fluid passing from the inlet, to the interior, through the defined space, and to the second passage.

2. The separator of claim 1, wherein the blocking body comprises one of a seal, a filter, and a funnel.

3. The separator of claim 1, wherein the second passage of the second inner body communicates the separated particular to the collector.

4. The separator of claim 1, wherein the first passage of the first inner body communicates the downhole fluid in the second passage to pass to the intake of the downhole pump.

5. The separator of claim 1, wherein the flow body comprises a spiral formed in the space between the first distal end of the first inner body at least partially disposed in the second distal end of the second inner body.

6. The separator of claim 1, wherein the outer body comprises a tubular housing having the uphole end coupled toward the intake and having the downhole end coupled toward the collector, the inlet being one or more openings defined in a sidewall of the tubular housing.

7. The separator of claim 1, wherein the first inner body comprises a first tubular disposed in the outer body and having a first diameter; and wherein the second inner body comprises a second tubular disposed in the outer body and having a second diameter greater than the first diameter.

8. The separator of claim 7, wherein the second tubular comprises one or more of: a full wall thickness all around along a length of the second tubular; a hard coating disposed at least in the second passage; a different material than the first tubular and/or the outer body; and a shorter length than the first tubular and/or the outer body.

9. A separator for an intake of downhole fluid in a downhole pump in a wellbore and for output of particulate to a collector disposed in the wellbore, the separator comprising:

a first inner body extending from adjacent the intake and defining a first passage communicating the intake with a first distal end;

a second inner body extending from adjacent the output and defining a second passage communicating the collector with a second distal end, the second distal end disposed about the first distal end and defining a space for fluid communication therebetween; and an outer body having an uphole end and a downhole end and supporting the collector to the downhole pump, the uphole end extending from adjacent the intake, the downhole end connected downhole to the collector disposed toward the output, the outer body disposed about the first and second inner bodies, the outer body having an inlet disposed toward the uphole end and communicating the wellbore with an interior of the outer body, the interior communicating with the space;

a blocking body disposed between the second distal end of the second inner body and an intermediate portion of the outer body between the uphole and downhole ends, the blocking body at least partially blocking communication of the inlet with a region between the second inner body and outer body; and wherein the space between the first and second inner bodies separates particulate from the downhole fluid passing from the inlet, to the interior, through the defined space, and to the second fluid passage.

10. The separator of claim 9, comprising a flow body disposed in the space between the first and second inner bodies and producing flow in the downhole fluid separating the particulate from the downhole fluid passing from the inlet, to the interior, through the defined space, and to the second fluid passage.

11. An apparatus for lifting fluid in a wellbore, the apparatus comprising:

a downhole pump having an intake;

an outer body having an uphole end and a downhole end, the uphole end extending from adjacent the intake, the outer body having an interior and having an inlet, the inlet disposed toward the uphole end and communicating the interior with the wellbore;

a collector extending from the downhole end of the outer body;

a first inner body disposed in the outer body and extending from adjacent the intake to a first distal end in the outer body, the first inner body defining a first passage communicating the first distal end with the inlet;

a second inner body disposed in the outer body and extending from adjacent the collector to a second distal end between the outer body and the first inner body, the second inner body defining a second passage, the second passage communicating the collector with the first passage and defining a space with the first inner body in fluid communication with the interior of the outer body;

a blocking body disposed between the second distal end of the second inner body and an intermediate portion of the outer body between the uphole and downhole ends, the blocking body at least partially blocking communication of the inlet with a region between the second inner body and outer body; and a flow body disposed in the space and producing flow in the downhole fluid separating particulate from the downhole fluid passing from the inlet, to the interior, through the defined space, and to the second fluid passage.

12. The apparatus of claim 11, wherein the blocking body comprises one of a seal, a filter, and a funnel.

13. The apparatus of claim 11, wherein the second passage of the second inner body communicates the separated particular to the collector; and wherein the first passage of the first inner body communicates the downhole fluid in the second passage to pass to the intake of the downhole pump.

14. The apparatus of claim 11, wherein the flow body comprises a spiral formed in the space between the first distal end of the first inner body at least partially disposed in the second distal end of the second inner body.

15. The apparatus of claim 11, wherein the outer body comprises a tubular housing having the uphole end coupled toward the intake and having the downhole end coupled toward the collector, the inlet being one or more openings defined in a sidewall of the tubular housing; wherein the first inner body comprises a first tubular disposed in the outer body and having a first diameter; and wherein the second inner body comprises a second tubular disposed in the outer body and having a second diameter greater than the first diameter.

16. The apparatus of claim 15, wherein the second tubular comprises one or more of: a full wall thickness all around along a length of the second tubular; a hard coating disposed at least in the second passage; a different material than the first tubular and/or the outer body; and a shorter length than the first tubular and/or the outer body.

17. A method of removing particulate from downhole fluid of a wellbore communicated to an intake of a downhole pump, the method comprising:

taking in the fluid into an interior through an inlet of an outer body in communication with the wellbore, the inlet disposed toward an uphole end of the outer body extending from adjacent the intake of the downhole pump and supporting a collector in the wellbore downhole of the downhole pump;

passing the fluid in the interior through a space between a first inner body disposed at least partially in a second inner body, the first inner body extending from the uphole end of the outer body into the interior, the second inner body extending from the downhole end of the outer body into the interior;

at least partially blocking communication of the inlet with a region between the second inner body and the outer body with a blocking body disposed between a second distal end of the second inner body and an intermediate portion of the outer body between the uphole and downhole ends;

separating particulate from the fluid passing through the space into a second passage of the second inner body;

collecting the separated particulate to the collector downhole of the second inner body; and taking up the fluid in the second passage through a first passage in the first inner body to the intake.

18. The method of claim 17, wherein at least partially blocking communication of the inlet with the region between the second inner body and the outer body with the blocking body comprises at least partially blocking the region with one of a seal, a filter, and a funnel as the blocking body.

19. The method of claim 17, wherein separating the particulate from the fluid passing through the space into the second passage of the second inner body comprises separating the particulate with a flow body at least partially disposed in the space between a first distal end of the first inner body and the second distal end of the second inner body.

20. The method of claim 17, comprising reducing erosion from the fluid by providing one or more of: a full wall thickness all around along a length of the second inner body; a hard coating disposed at least in the second passage; a different material for the second inner body than for the first inner body and/or the outer body; and a shorter length for the second inner body than for the first inner body and/or the outer body.

* * * * *